US007056054B1

(12) United States Patent
Keith et al.

(10) Patent No.: US 7,056,054 B1
(45) Date of Patent: Jun. 6, 2006

(54) STOP STICK DEPLOYMENT DEVICE AND METHOD

(76) Inventors: Brett Keith, 4304 Worchester Ct., Carmel, IN (US) 46033; Lowell Keith, 4302 Worchester Ct., Carmel, IN (US) 46033; Donald Snow, 306 S. Cherry St., Westfield, IN (US) 46074

( * ) Notice: Subject to any disclaimer, the term of this patent is extended or adjusted under 35 U.S.C. 154(b) by 41 days.

(21) Appl. No.: 10/991,282

(22) Filed: Nov. 18, 2004

(51) Int. Cl.
*E01F 13/12* (2006.01)

(52) U.S. Cl. ..... 404/6

(58) Field of Classification Search ..... 404/6, 404/9; 256/1, 13.1; 403/186
See application file for complete search history.

(56) References Cited

U.S. PATENT DOCUMENTS 5,611,408 A * 3/1997 Abukhader ..... 180/287
5,839,849 A * 11/1998 Pacholok et al. ..... 404/6
6,048,128 A * 4/2000 Jones et al. ..... 404/6
6,527,475 B1 * 3/2003 Lowrie ..... 404/6
6,623,205 B1 * 9/2003 Ramirez ..... 404/6
6,758,628 B1 * 7/2004 Curry, Jr. ..... 404/6

* cited by examiner

*Primary Examiner*—Raymond W Addie
(74) *Attorney, Agent, or Firm*—Daniel J. O'Connor

(57) ABSTRACT

A system and method for safely deploying a tire deflation device. Tire deflation units or stop sticks are released from a specially designed deployment unit positioned on the back of a police vehicle. A remote control feature allows a police officer to release a stop stick unit onto a roadway without exiting a police vehicle during a chase. A specially designed tire deflation or stop stick subcombination is also described. The overall design significantly improves safety and performance for law enforcement agencies involved in apprehending suspect fleeing vehicles. The invention also has utility for counter-terrorism activities when it is desired to disable a terrorist's vehicle at a certain location.

1 Claim, 5 Drawing Sheets

STOP STICK DEPLOYMENT DEVICE AND METHOD

BACKGROUND AND OBJECTS OF THE INVENTION

The following invention is generally related to the dispensing and roadway treatment arts and, in particular, to a system and method for deploying tire deflation devices upon a roadway.

Vehicle tire deflation devices, as currently used by law enforcement personnel, have come to be known in the art as stop sticks.

Such tire deflation devices have performed well in stopping vehicles fleeing law enforcement.

One problem in the art has been that the tire deflation devices are typically manually placed upon a roadway by police personnel. Such personnel are thus placed in possible danger since they are required to leave the safety of a police vehicle.

That is, the police personnel may be in danger of being struck by the fleeing vehicle, by the occupants of the fleeing vehicle or by other innocent bystander vehicles in the area.

Accordingly, it is therefore an object of the present invention to set forth a novel device for deployment and placement of vehicle tire deflation devices which greatly reduces the risk of danger to police personnel.

It is also an object of the invention to demonstrate a novel method of stop stick deployment which efficiently places tire deflation devices on a roadway without a police officer having to be in a dangerous out-of-vehicle situation during a police chase.

It is a further object of the invention to show a novel deployment system for tire deflation devices which may be economically mass-produced for widespread commercial appeal in the law enforcement and roadway treatment and vehicle stopping arts.

These and other objects and advantages of the present invention will be apparent to those of skill in the art from the description which follows.

PRIOR ART PATENTS AND DESIGNS

During the course of preparing this specification for submission to the U.S. Patent and Trademark Office, a full search of the prior art was conducted.

U.S. Pat. Nos. 5,452,962 and 6,155,745 illustrate the state of the art relating to tire deflation devices in general. These are of a type which are designed to be manually placed upon a roadway to stop a vehicle being pursued.

U.S. Patent Office Classes 221 and 222 show numerous patents relating to dispensing and article dispensing structures and methods.

A particular use relating to a structure to dispense stop sticks on a roadway has not been found in the prior art, especially the particular structures and methods shown in the present specification. Accordingly, the present invention is believed to clearly define over the known prior art.

SUMMARY OF THE INVENTION

Disclosed is a deployment system and method wherein vehicle tire deflation means known as stop sticks are placed on a roadway in order to stop a fleeing suspect vehicle.

Importantly, the deployment system enables a police officer to remain inside his vehicle and to deploy stop sticks while the police vehicle is moving at a high rate of speed.

The invention comprises a gated container for stop sticks, the gated container being mounted on the rear undercarriage of a vehicle. In the method of use, a specially designed stop stick combination is loaded into the bottom of a gated container and a lower gate is locked.

One use of the system and method includes the disabling of a vehicle being driven by a terrorist. The design thus has utility for counter-terrorism activities.

BRIEF DESCRIPTION OF THE DRAWING FIGURES

FULL DESCRIPTION OF THE PREFERRED EMBODIMENTS

Figure 1:
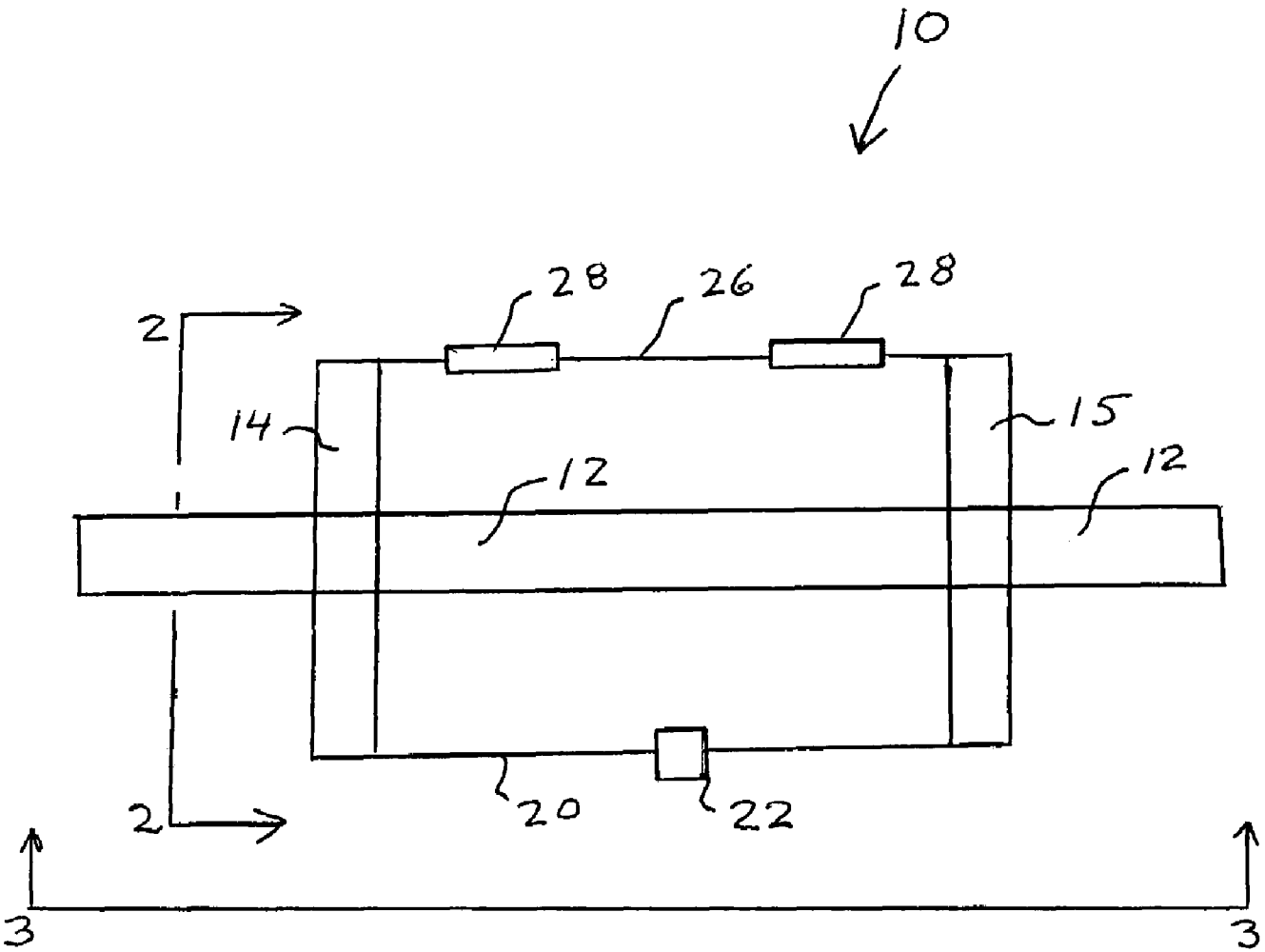
FIG. 1 is a top view of some of the components of the deployment system.

As shown in FIG. 1, the deployment system 10 includes a top bar 12 which is of sufficient strength to be mounted to a vehicle as will be further described.

Mounted to the top bar 12 is a left bracket 14 and a right bracket 15.

As further indicated in the top view of FIG. 1, a locking element 22 is positioned on a lock bracket 20.

A hinge bracket 26 serves to support hinge elements 28 which are attached to a gate to be further described.

In the embodiment shown, it is contemplated that the length of top bar 12 would be on the order of forty two inches.

The spacing between the left bracket 14 and the right bracket 15 would be on the order of twenty seven inches. The length of the bracket portions shown in FIG. 1 is on the order of nine inches. These dimensions will vary for different applications.

Figure 2:
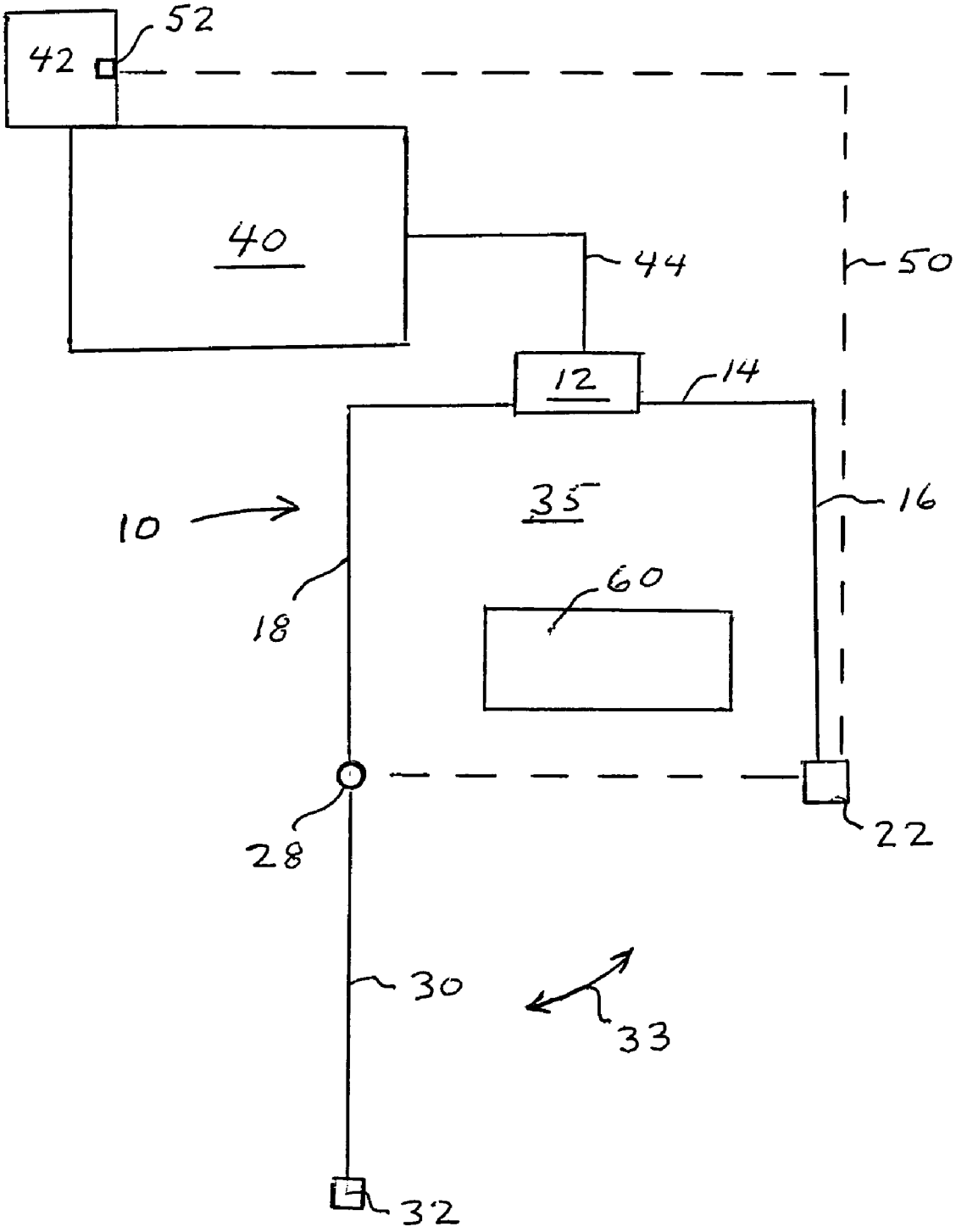
FIG. 2 is an end view along lines 2—2 of FIG. 1 and illustrates schematically the relation between the deployment system and a vehicle and the vehicle passenger compartment. Remote operation of the deployment system is also illustrated.

Referring to FIG. 2 which is an end view along line 2—2 of FIG. 1, the top bar 12 and left bracket 14 are again shown.

Left bracket 14 has a rear depending leg 16 and a forward depending leg 18.

Also visible in FIG. 2 are the locking element 22 and hinge means 28.

A gate 30 is rotatably supported by the hinges 28 and includes a latch 32 which cooperates with locking element 22 to form a chamber 35 when the gate is in an upper position. The movement of gate 30 from closed to open positions is indicated by arrow 33 in FIG. 2.

FIG. 2 also schematically shows a rear portion of a vehicle 40 and a vehicle passenger compartment 42. As will be understood, the overall deployment device 10 is mounted to the rear of vehicle 40 by means of a vehicle mounting element 44.

The opening of the lock and latch combination is controlled by a line or cable 50 which is activated by a remote switch or button 52 within passenger area 42.

As further indicated in FIG. 2, a tire deflation device is placed within the chamber 35. Gate 30 is then rotated into the closed or locked position. The tire deflation device is indicated at numeral 60 and will be further described hereinbelow.

The significant method steps thus used in practice of the invention are as follows:

a) manufacturing a deployment device 10 of the type shown in FIGS. 1 and 2,
b) attaching said deployment device to the rear of a vehicle 40,
c) running a line or cable 50 from the deployment device 10 to the passenger compartment 42 of said vehicle,
d) loading a tire deflation device into the bottom of said deployment device 10,
e) closing a gate 30 on said deployment device,
f) when deemed necessary, activating a lock and latch so that gate 30 goes to an open position and the tire deflation device is dropped onto a roadway.

Figure 3:
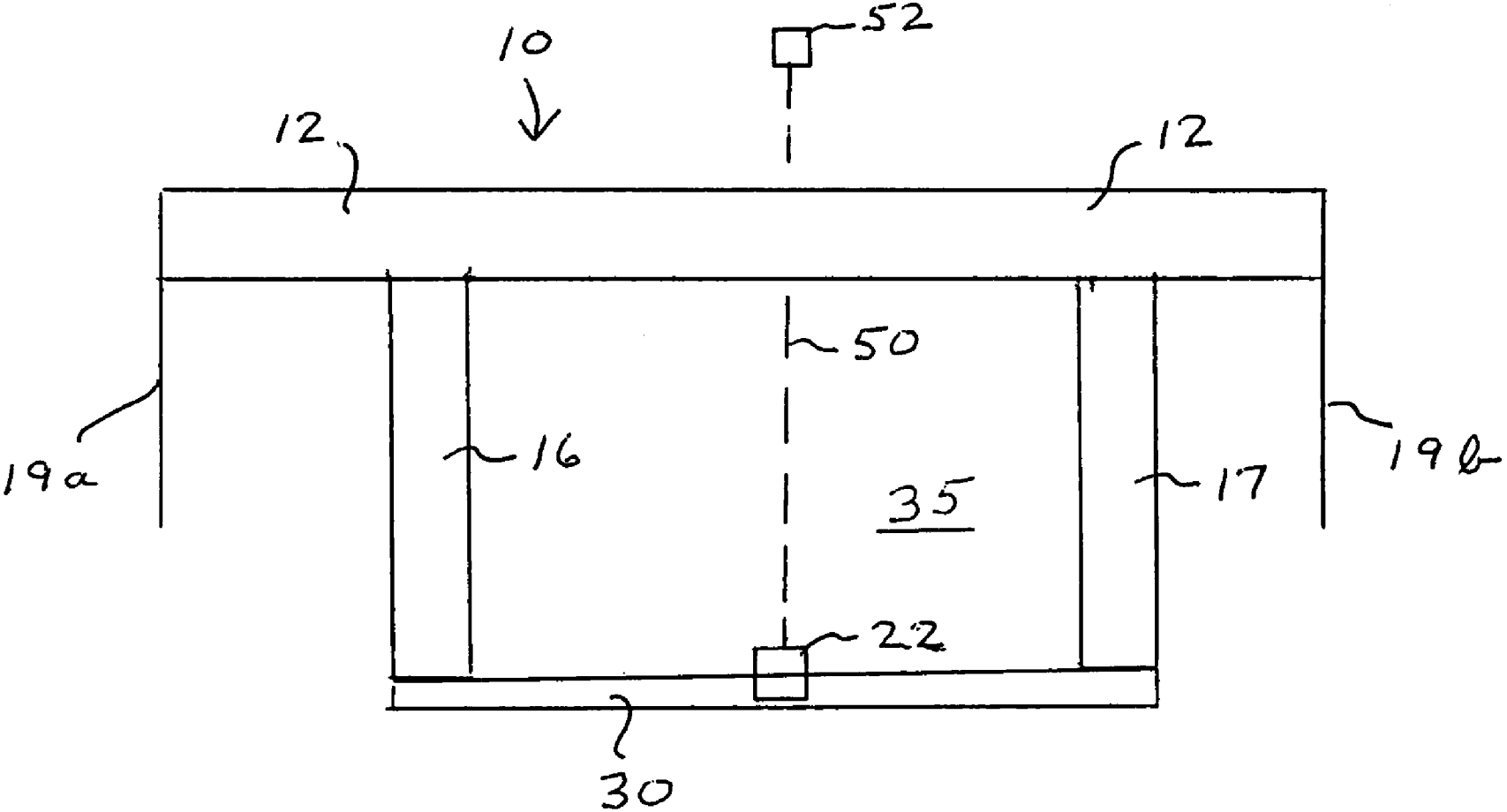
FIG. 3 is a rear, side view along lines 3—3 of FIG. 1 and illustrates, inter alia, protective side brackets.

Referring to the side view of FIG. 3, further detail of the deployment device 10 is shown.

The top bar 12, rear depending leg 16, lock 22, cable 50, activating button 52, and the opening gate 30 were previously described.

In FIG. 3, gate 30 is shown in the up or closed position.

FIG. 3 also shows a second rear depending leg 17 in parallel with leg 16. The legs 16 and 17 support a lock bracket 20 which was shown in FIG. 1.

FIG. 3 also shows side or lateral brackets 19*a* and 19*b* which extend downwardly from the top bar 12.

These side or lateral brackets 19*a* and 19*b* serve to provide the side panels for chamber 35.

Thus, when a tire deflation device is loaded into the chamber 35, it is retained therein until the gate 30 is opened, without sliding out the sides of unit 10.

Figure 4:
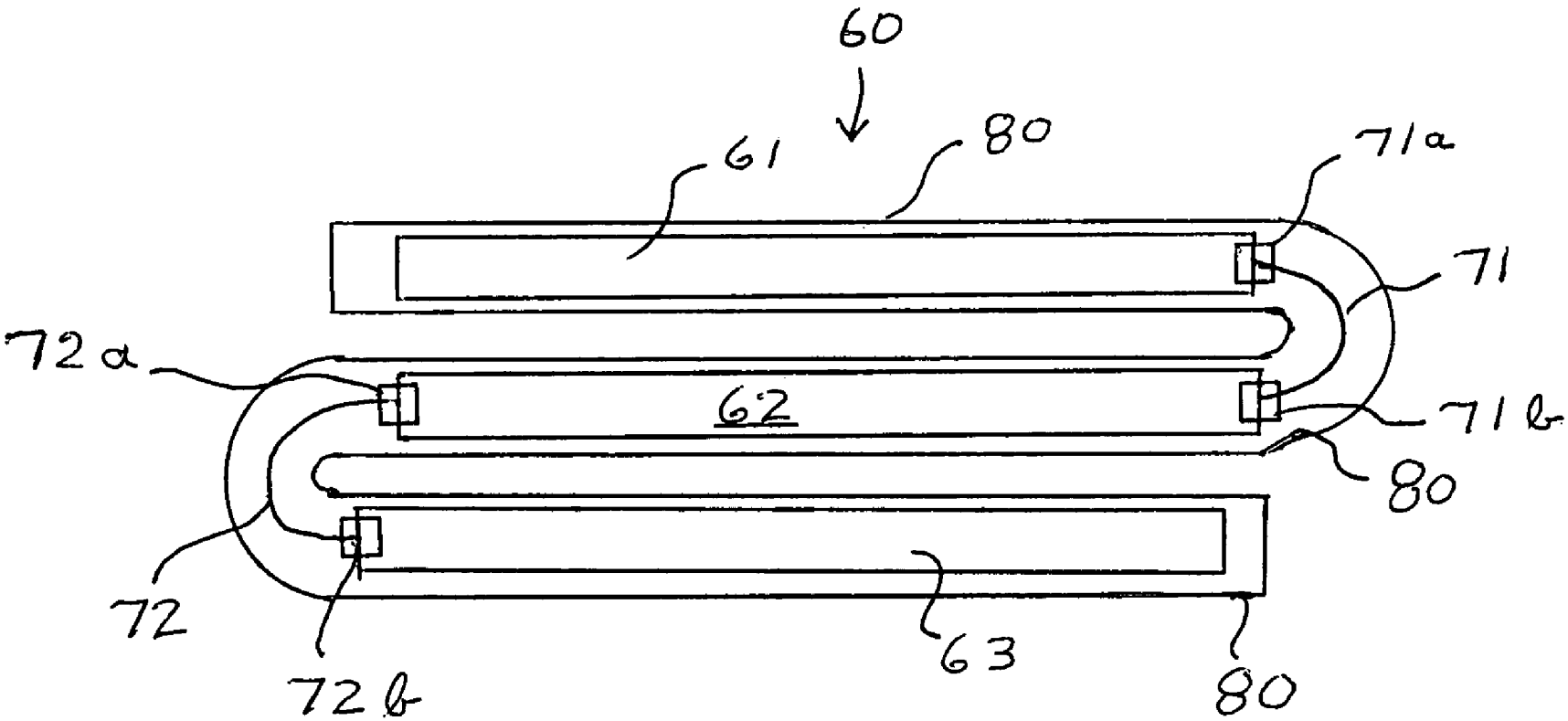
FIG. 4 is a schematic view of a specially designed stop stick configuration which is in a folded position and ready to be loaded into the deployment device.

Referring to FIG. 4, a schematic view of the tire deflation device used in the invention is shown.

The tire deflation device 60 is shown in a folded position and ready to be loaded into a chamber 35 of a deployment device 10 previously described.

Three individual stop sticks 61, 62 and 63 are contained within a nylon bag.

The stop sticks or tire deflation elements 61, 62 and 63 are connected to each other via spring metal straps 71 and 72 as shown.

The means of connecting the spring metal straps to the stop sticks are indicated at numerals 71*a*, 71*b*, 72*a* and 72*b*. Such connecting means may comprise, for example, high strength tape or pockets formed as a part of the stop sticks.

Other equivalent connecting means known in the mechanical and connecting arts may be utilized.

After the stop sticks have been placed into the nylon bag 80 and folded into the position shown in FIG. 4, they are loaded into a deployment device 10 as previously described.

Figure 5:
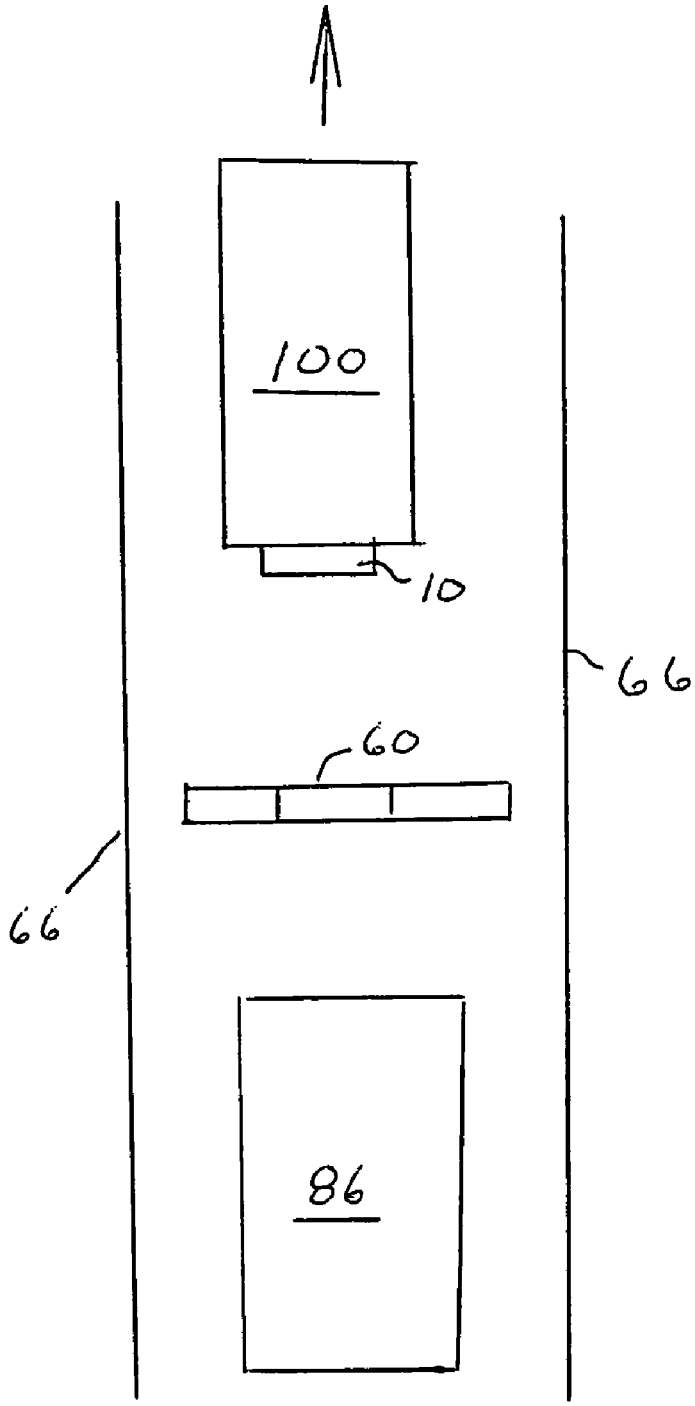
FIG. 5 is an aerial schematic view of the specially designed stop stick configuration as deployed upon a roadway by a police vehicle to stop a suspect fleeing vehicle.

When dropped or released from a deployment unit 10, the tire deflation device tends to immediately straighten out to a configuration shown in FIG. 5. Such is due to the spring metal elements 71 and 72 positioned between the stop sticks 61, 62 and 63.

As indicated in FIG. 5, the method of use for stopping a suspect fleeing vehicle would be to position a law enforcement vehicle 100 in front of the fleeing vehicle.

Assuming a fleeing vehicle 86 is traveling on roadway 66, a police vehicle 100 having a deployment device 10 mounted on the back thereof can release a stop stick unit 60 onto the roadway to effectively flatten the tires of the fleeing vehicle. Importantly, such operation is carried out without a police officer being required to step out of the police vehicle.

The general sizing of the overall deployment unit is a previously described.

It is noted that variously sized units may be manufactured depending upon conditions encountered. For example, the deployment unit may include adjustment means so that the lateral brackets 19*a* and 19*b* may be shifted outwardly to accomodate longer tire deflation units.

While a particular system and a method of use have been described, it is intended in this specification to cover all equivalent systems and methods which would reasonably occur to those of skill in the art. The invention is further defined by the claims appended hereto.

We claim:

1. A deployment device in combination with a tire deflation unit comprising:

a single upper bar which extends transversely and which attaches the deployment device to a vehicle by a vehicle mounting element, said upper bar having a left hand bracket and a right hand bracket mounted thereon, each of said brackets having downwardly extending leg elements, said deployment device further including a lock bracket which supports a lock and a hinge bracket which supports hinge elements, said deployment device further including a gate which opens downwardly and releases the tire deflation unit to the rear of a police vehicle, wherein said upper bar, said left and right hand brackets, said downwardly extending legs and said gate form a chamber which contains the tire deflation unit, wherein said gate includes a latch element which cooperates with said lock, said combination including a line or cable extending from said lock to a passenger compartment of said vehicle and which opens said gate at a desired time to stop a suspect and fleeing vehicle, thereby providing a system whereby a police officer can place said tire deflation elements on a roadway without exiting a police vehicle, said tire deflation unit comprising a first tire deflation or stop stick element, a second tire deflation or stop stick element, a spring metal strap which connects said first and second tire deflation elements together, said tire deflation elements and said connecting metal strap being contained within an elongated bag, wherein the the overall unit is folded and placed into the chamber of the deployment device.

* * * * *